US009415406B2

(12) United States Patent
Kah, Jr.

(10) Patent No.: US 9,415,406 B2
(45) Date of Patent: Aug. 16, 2016

(54) SPEED LIMITING TURBINE WITH MOMENTUM ACTIVATED BYPASS VALVE

(76) Inventor: Carl L. C. Kah, Jr., North Palm Beach, FL (US)

( * ) Notice: Subject to any disclaimer, the term of this patent is extended or adjusted under 35 U.S.C. 154(b) by 942 days.

(21) Appl. No.: 13/293,627

(22) Filed: Nov. 10, 2011

(65) Prior Publication Data

US 2012/0205465 A1 Aug. 16, 2012

Related U.S. Application Data

(60) Provisional application No. 61/412,110, filed on Nov. 10, 2010.

(51) Int. Cl.
*B05B 3/04* (2006.01)

(52) U.S. Cl.
CPC ..... *B05B 3/0418* (2013.01); *B05B 3/0463* (2013.01)

(58) Field of Classification Search
CPC ..... B05B 3/04; B05B 3/0418; B05B 3/0463; B05B 3/0468; B05B 3/0495
USPC ..... 239/240, 225.1
See application file for complete search history.

(56) References Cited

U.S. PATENT DOCUMENTS 5,375,768 A * 12/1994 Clark ..... B05B 15/10 239/205
6,921,030 B2 * 7/2005 Renquist ..... B05B 3/003 137/119.07
7,134,613 B2 * 11/2006 Kah, III ..... B05B 3/045 239/237
2002/0162902 A1 * 11/2002 Kah, Jr. ..... B05B 3/003 239/240

* cited by examiner

*Primary Examiner* — Len Tran
*Assistant Examiner* — Joel Zhou
(74) *Attorney, Agent, or Firm* — Ostrolenk Faber LLP

(57) ABSTRACT

A speed limiting mechanism for a turbine-driven fluid distribution apparatus usable with compressible fluid such as compressed air and incompressible fluid such as water. In one form, a flow restrictor is located in the turbine discharge flow path, with the turbine discharge port area selected in relation to the turbine inlet port area according to the desired turbine speed with compressed air. In another form, the incoming fluid flows downstream along the surface of the turbine stator, and is then diverted to enter the rotor chamber in the proper direction. A bleed area on the stator which permits a portion of a compressible fluid which has expanded as it flows along the stator surface to flow to bypass the turbine rotor. In another embodiment, a valve may be provided upstream from the turbine to selectively divert at least a portion of the pressurized fluid around the turbine when the pressurized fluid air or a combination of air and water.

4 Claims, 7 Drawing Sheets

SPEED LIMITING TURBINE WITH MOMENTUM ACTIVATED BYPASS VALVE

CROSS-REFERENCE TO RELATED APPLICATIONS

The present application claims benefit of and priority to U.S. Provisional Patent Application Ser. No. 61/412,110 entitled SPEED LIMITING TURBINE WITH MOMENTUM ACTIVATED BYPASS VALVE filed Nov. 10, 2010, the entire content of which is hereby incorporated by reference herein.

BACKGROUND

1. Field of the Disclosure

The present disclosure relates to a sprinkler with a water driven turbine that causes a sprinkler nozzle to rotate to provide coverage over a desired area. More specifically, the present disclosure relates to a sprinkler with a water driven turbine that includes at least one valve that selectively diverts fluid from the turbine to prevent over speeding when the fluid is air or a combination of air and water.

2. Related Art

Sprinkler systems in northern climates should be drained or blown-out with air to clear the water and to prevent freezing damage. In many cases the simplest installation provides only for allowing the irrigation system pipes and sprinklers to be cleared of water by blowing out the system using compressed air. This can be very damaging to sprinklers including water turbines, which are normally water powered. These systems rotate at a slower speed when water is used to drive them since water is a relatively heavy incompressible fluid and does not generate high turbine stator velocities. When air from blowing out the system drives the turbines, however, very high velocities result since air is an expandable, relatively light fluid, that expands across the turbine stator onto the turbine blades.

The high turbine shaft velocities resulting from such air driving the turbine can heat the shaft and cause it to seize to the plastic housing material. This prevents the turbine from turning and renders it unusable in the future unless care is taken to limit the system air, blow-out time and pressures. This has proven to be one of the major causes for premature failure of gear driven sprinklers in colder climates. Since these sprinklers are typically only used for part of the year, they should last much longer than in warmer climates where they are run year round.

Devices are known for controlling the rotational speed of turbine-driven sprinklers. One such device, shown in Clark U.S. Pat. No. 5,375,768, is designed to maintain constant turbine speed despite variations of inlet water pressure. The patented sprinkler relies on a throttling device to direct part of the water to the turbine rotor, and a pressure responsive valve to divert some of the water around the turbine. This design, however, cannot effectively limit rotational speed when the turbine is driven by a compressible fluid such as air, and still allow the turbine to run at a sufficiently high speed when it is driven by an incompressible fluid such as water because of the rapid expansion of the compressed air as it enters the turbine chamber.

Other turbine speed limiting mechanisms are known, but to applicant's knowledge, none are known that limit turbine over-speed by distinguishing the difference in the momentum of the turbine drive fluid when it contains air to divert a portion or all of the high velocity yet much lower momentum drive fluid around the turbine blades, thus limiting turbine available power and speed.

SUMMARY

It is accordingly an object of the present disclosure to provide a turbine-driven sprinkler with a speed limiting mechanism that protects the turbine from damage when compressed air is used to blow out the system in preparation for winter, but still permits satisfactory operation when the turbine is water-driven.

A related object of the present disclosure is to provide a turbine-driven sprinkler having a speed limiting mechanism for air (compressible flow) as described which is reliable and can be manufactured inexpensively.

The above objects are achieved according to one embodiment by choking the turbine flow discharge area to be relatively the same as or slightly larger than the inlet stator area. According to another embodiment, the inlet stator flow area can be separated from the turbine blades by a flow bleed area to bleed off a significant portion of the expanding flow before a portion of the gases are deflected to strike the turbine blades to produce the turbine rotation. Water, being incompressible, does not experience the continued expansion after flow through the stator inlet flow area and does not flow out the intermediate bleed but continues in its line of flow to be directed onto the turbine blades to run the turbine in a normal manner. In the case of air (compressible flow) the portion remaining after the intermediate bleed can be limited to just enough to turn the turbine at its normal speed when water-driven.

In a third embodiment, the sprinkler includes at least one valve that selectively diverts fluid, or a portion of the fluid around the turbine when the fluid is air or a combination of water and air.

A sprinkler in accordance with an embodiment of the present disclosure includes a riser for receiving a pressurized fluid, a nozzle, a mounting device configured to mount the nozzle at an upper end of the riser for rotation about an axis, a turbine mounted for rotation inside the riser and in fluid communication with the pressurized fluid, a drive device connected between the turbine and the nozzle such that rotation of the turbine by the pressurized fluid will rotate the nozzle; and a valve configured to selectively re-direct at least a portion of the pressurized fluid around the turbine when the pressurized fluid is air or a mixture of water and air.

A sprinkler in accordance with an embodiment of the present disclosure includes a riser for receiving a pressurized fluid, a nozzle, a mounting device configured to mount the nozzle at an upper end of the riser for rotation about an axis, a turbine mounted for rotation inside the riser and in fluid communication with the pressurized fluid, a drive device connected between the turbine and the nozzle such that rotation of the turbine by the pressurized fluid will rotate the nozzle, and a bypass element provided upstream from the turbine and configured to allow at least a portion of the pressurized fluid to pass the turbine without rotating the turbine.

A sprinkler in accordance with an embodiment of the present disclosure includes a riser for receiving a pressurized fluid, a nozzle, a mounting device configured to mount the nozzle at an upper end of the riser for rotation about an axis, a turbine mounted for rotation inside the riser and in fluid communication with the pressurized fluid, a drive device connected between the turbine and the nozzle such that rotation of the turbine by the pressurized fluid will rotate the nozzle, a first valve positioned upstream from the turbine and configured to selectively re-direct at least a portion of the pressurized fluid around the turbine when the pressurized fluid is air or a mixture of water and air, and a second valve positioned upstream from the first valve and configured to maintain a desired pressure differential across the turbine.

Other features and advantages of the present invention will become apparent from the following description of the invention, which refers to the accompanying drawings.

DETAILED DESCRIPTION OF THE EMBODIMENTS

Figure 1:
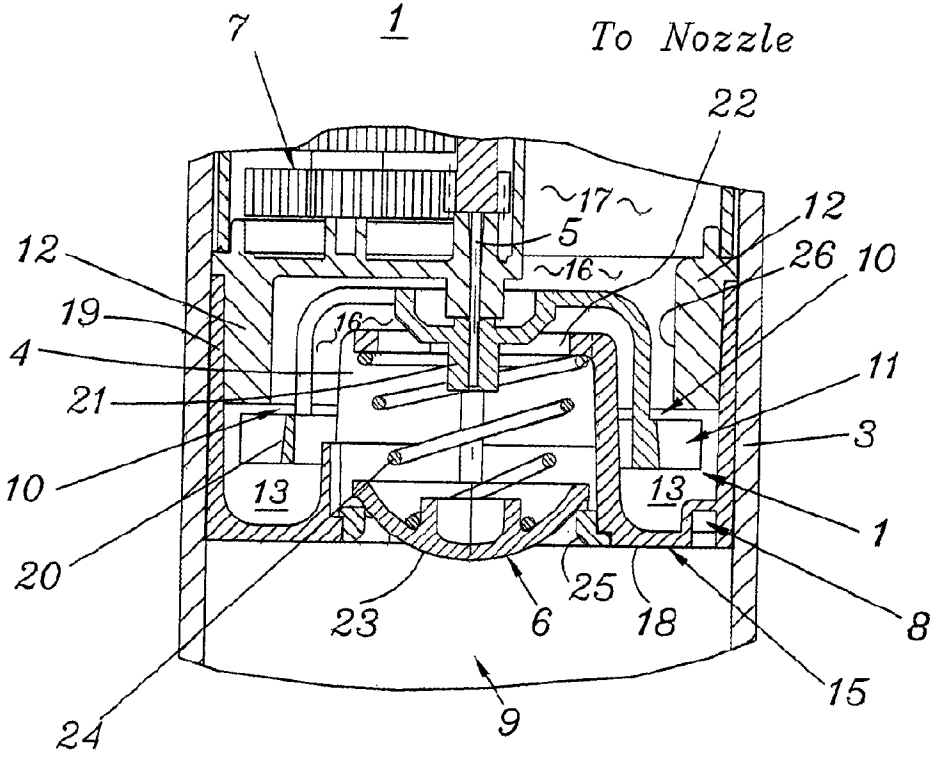
FIG. 1 is a cross-section of an elevation view of the drive turbine area of a turbine-driven sprinkler according to a first embodiment of the present disclosure.

FIG. 1 shows in cross-section, the turbine assembly, generally denoted at 1, of a water turbine driven sprinkler such as described in detail in U.S. Pat. No. Re 35,037, the disclosure of which is hereby incorporated herein by reference as if fully set forth herein. The turbine assembly 1 is mounted in a housing 3, typically in a riser of the sprinkler, and, by way of an output shaft 5, drives a gear box 7 which rotates or oscillates a sprinkler head (not shown). As will be understood, water (or during winterization, compressed air) entering turbine assembly 1 from below at 9 drives the turbine, and thereafter flows through an outlet passage 17 to the sprinkler head. The sprinkler head typically includes an outlet nozzle through which water exits the sprinkler.

The turbine itself includes a rotor 11 located in a rotor chamber 13 formed by a stator cover assembly 15 positioned on the upstream side of the turbine, and a lower cover 12 for gearbox 7. Stator cover assembly 15 is in the form of an inverted cup with a central portion 4 that houses a flow bypass valve sub-assembly 6 described below. Extending radially from the bottom of central portion 4 is a shoulder 18, which terminates in an upwardly extending skirt portion 19.

Circumferentially spaced around the bottom shoulder 18 of stator cover 15 is a plurality of tangentially directed turbine stator flow inlet ports 8 through which water flows into rotor chamber 13. As the incoming fluid passes through openings 8, it experiences acceleration due to the pressure difference between the inlet area 9 in the turbine housing and the pressure in cavity 13 as maintained by the turbine by-pass assembly valve 6, and then tangentially strikes the turbine rotor 11, causing it to turn, and to drive gearbox box 7 through shaft 5. The fluid then exits rotor chamber 13 through an annular discharge port 10 between the turbine rotor 11 and a circumferential blade support ring 20 and the lower gear box cover ring 12. Discharge port 10 communicates with an outer chamber 16 above stator cover 15, which, in turn, communicates with discharge passage 17.

The hub portion 21 of rotor 11 passes through a circular opening 22 at the top of stator 15. Circular opening 22 also provides communication between the interior of stator cup 4 and outer chamber 16.

Located within stator cup 4 is turbine by-pass valve assembly 6. This is comprised of a valve plug 23, which is biased into a closed position against the upper surface of a valve seat member 25 by a spring 24. As will be understood, when the inlet fluid pressure is sufficient to overcome the force of spring 24, a portion of incoming fluid is diverted by valve 6 to discharge passage 17 through the interior of stator cup 4, circular opening 22, and outer chamber 16. The purpose of this valve is to maintain the desired differential pressure across the turbine inlet ports 8, to drive the turbine at the desired speed and power with water.

Achieving proper performance for the sprinkler both when the turbine is water-driven and also preventing over speeding when it is air-driven depends on the selection of the area of turbine circumferential discharge port 10 and the flow pressure drop established by flow control valve 6. To assure overspeed protection for turbine rotor 11 during blow out, the area of discharge port 10 must be restricted, but the area must be large enough for the turbine to provide the desired torque to gearbox 7 for the pressure drop established by spring 24 of the flow bypass valve assembly 6 when operating in water.

In any event, the discharge port area must be, at a minimum, slightly larger than the collective area of the multiple turbine stator inlet ports 8. However, since the water is incompressible, and does not expand, increasing the area beyond a certain point does not improve turbine torque performance and just allows for greater expansion and flow of air when the turbine is air-driven, and allows it to overspeed.

For a turbine driven by an incompressible fluid such as water, and especially in the simple, single-stage turbines used to drive sprinklers, the turbine flow exit velocity remains relatively high, the difference in velocity resulting from energy absorbed by the turbine wheel and flow friction inefficiencies. Thus, in accordance with the continuity equation for flow that requires that the product of inlet flow area and inlet flow velocity must equal the product of the exit flow area and the exit flow velocity, large increases in exit flow area are not required for proper operation and power for water.

Taking all these factors into consideration, good results, in terms of enhancement of the life of turbine-driven sprinklers, and elimination of destructive turbine over-speeding during blowout with air, can be achieved by limiting the turbine discharge area to no more than twice the collective turbine stator inlet area, and preferably about 1.5 times the collective turbine stator inlet area. This can be made smaller (but no less than equal to the collective turbine stator inlet area) to limit even further the turbine speed when driven by air.

As shown in FIG. 1, the area of discharge port 10 is determined by the spacing between inside wall 26 of ring 12 and the outer wall of turbine ring 20. Thus, the area of discharge port 10 is determined by the internal diameter of ring 12 and the outside diameter of ring 20.

In most of the sprinklers being manufactured today, the turbine discharge area is not restricted and is simple to open to allow turbine flow to move through the sprinkler housing 2 and area 16 and 17 up to the sprinkler's discharge nozzle (not shown).

FIGS. 2-5 illustrate a second embodiment of the present disclosure in which a different mechanism is employed for limiting turbine over-speed when it is run on compressed air during winterization.

Figure 2:
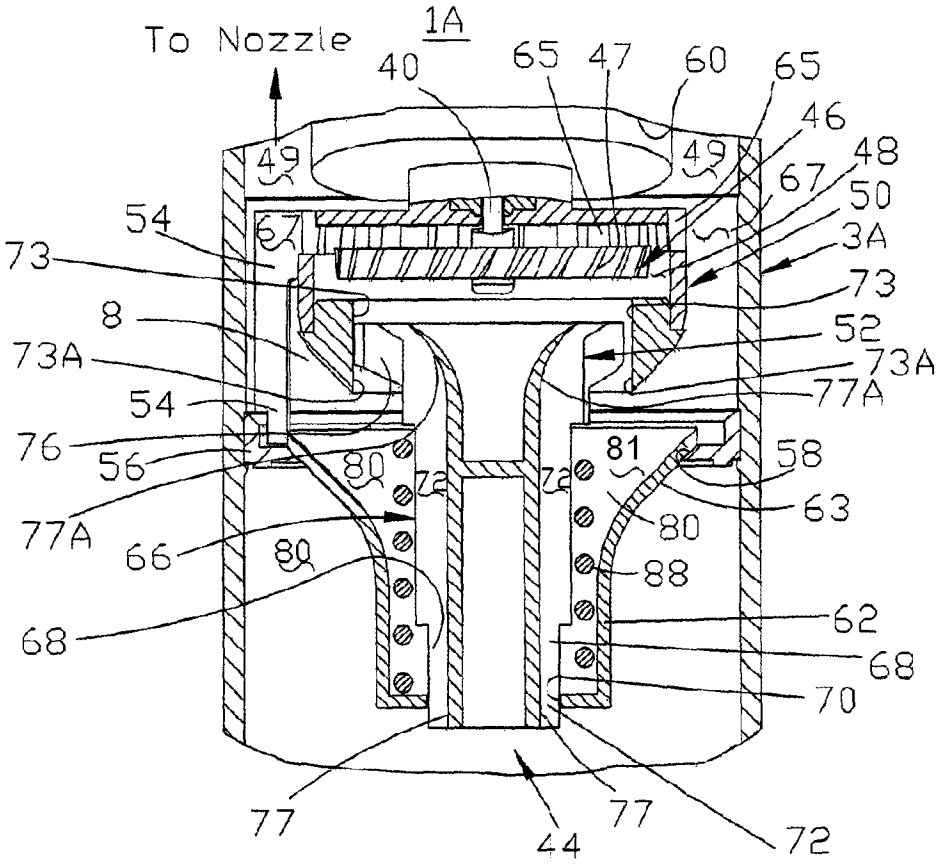
FIG. 2 is a cross-section of an elevation view of the drive turbine area of a turbine-driven sprinkler according to a second embodiment of the present disclosure which shows the spring loaded flow bypass valve in the fully closed position.
Figure 3:
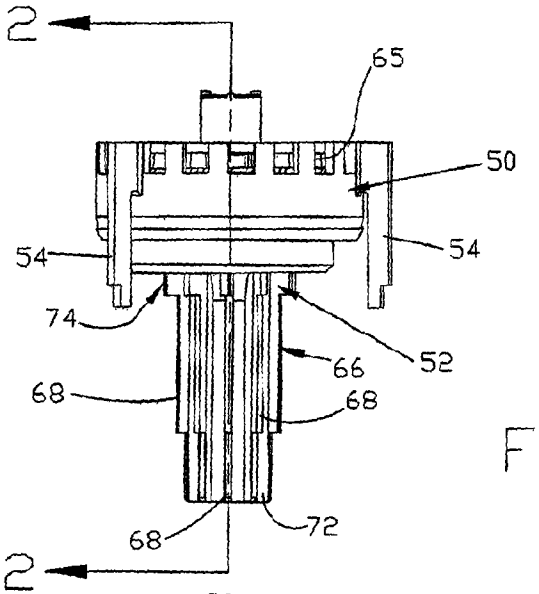
FIG. 3 is a side elevation of the rotor housing and the flow deflector according to the second embodiment.

Referring to FIGS. 2 and 3, modified turbine assembly 1A is mounted in a housing 3A, and, by way of an output shaft 40, drives a gearbox 60, which rotates or oscillates a sprinkler head (not shown). Water or compressed air entering turbine assembly 1A from below at 44 drives the turbine, and thereafter flows through outlet passages 67 and 49 to the sprinkler nozzle.

The turbine includes a rotor 46 located in a rotor chamber 48 formed by an internal housing 50 having spaced legs 54 around its outside circumference. A flow directing swirl member 52 includes a lower (upstream) body portion 66 having a plurality of circumferentially spaced longitudinal ribs 68. A by-pass flow valve 62 described below having a central opening 70 is positioned in radially spaced relationship around the upstream body portion 66. As illustrated in FIG. 2, opening 70 cooperates with ribs 68 and surface 77 of lower body portion 66 of swirl member 52 to form a series of longitudinal passages 72 running from inlet 44 up along swirl member 66. At its upper end 74, surface 77 is curved outwardly as shown at 77A.

Figure 4:
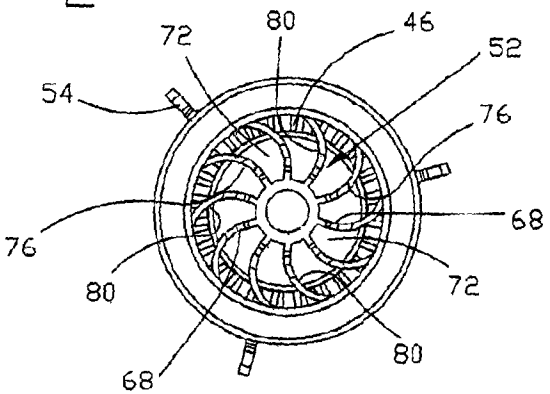
FIG. 4 shows a top view of the flow deflector stator.

At the upper (downstream) end 74 of swirl member 66, the radial inner edges of ribs 68 are also curved outwardly and circumferentially to form swirl deflector surfaces 80. These cooperate with a series of circumferentially spaced swirl ribs 76 that spiral outwardly as shown in FIG. 4 to cause the axially flowing fluid in flow passages 72 to be deflected outwardly and circumferentially so that it passes through a swirl ring opening 73 where it strikes the blades 47 of turbine rotor 46. After imparting energy to rotate the turbine, the fluid flows out through a series of radial exit ports 65 into a flow area 67 between interior housing 50 and exterior housing 3A, and from there, through outlet passage 49 to the sprinkler head (not shown).

When the turbine is water-driven, the inertia of the incompressible water carries it straight up ribbed passages 72, past deflector surfaces 77A and swirl ribs 76, and though swirl ring opening 73 to strike turbine rotor blades 47 which are rotating in rotor chamber 48. However, when compressed air is used to blow out the irrigation system during winterization, the air continues to expand after traveling through passage 72 as it moves upwardly, and a significant amount escapes through open bleed area 81 into a bypass flow area 67, and from there, into discharge area 49 around gear box 60 to the sprinkler nozzle at the exit top end of the sprinklers.

Only the air that continues straight up along the ribbed passages 72 passes through the swirl ring opening 73 to drive turbine rotor 46, and thus the energy transferred to the rotor is much less than if the entire incoming air flow had been allowed to enter rotor chamber 48. The shape and opening size of the swirl ring opening 73A can be used to determine how much airflow is allowed to reach the turbine without limiting the water flow.

Bypass flow valve 62 includes an outwardly tapered upper portion 63 that serves a valve closure member with ring 56. A beveled radially inner surface 58 of ring 56 forms a valve seat that cooperates with valve closure member 63. A spring 88 biases valve closure member 63 upward against valve seat 58 so that valve 62 is normally closed, as illustrated in FIG. 2.

Figure 5:
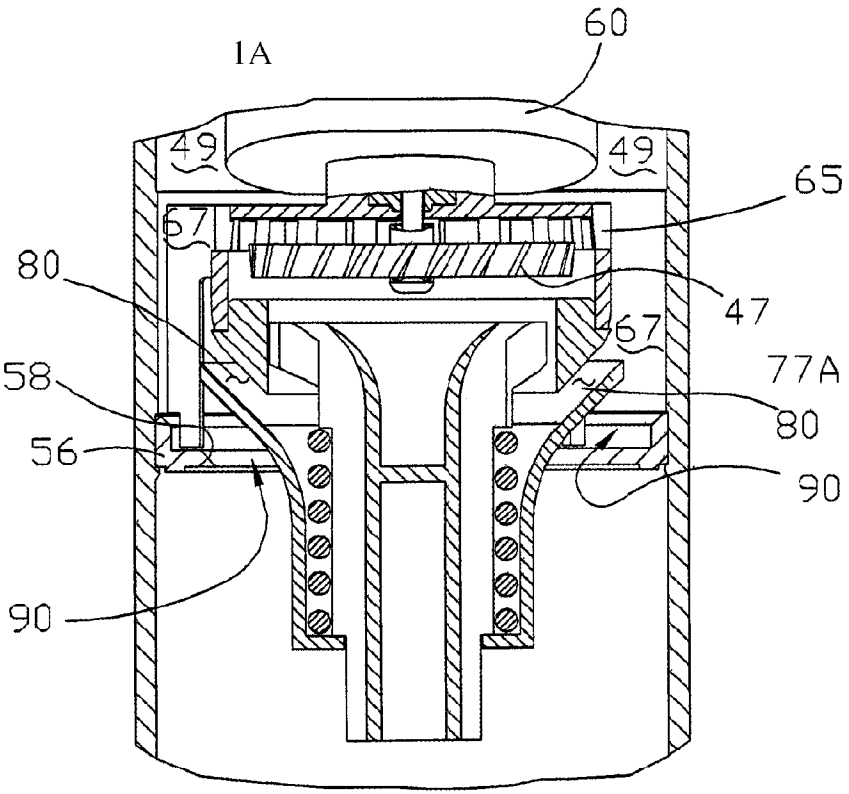
FIG. 5 shows a cross-section of an elevation view of the turbine area of FIG. 2 but with the flow bypass valve in the fully open position.

In FIG. 5, by-pass flow valve 62 is shown in its open position. This allows flow in excess of what is needed to drive the turbine to be bypassed through valve opening 90 around the turbine and up through discharge passage 49 around the gear box 60. Once the required differential pressure is established across opening 72 to provide the desired turbine speed and power by the strength of spring 88 acting on valve member 62, the balance of the flow is bypassed by allowing valve 62 to open as previously explained.

The turbine rotor speed is a result of momentum interchange between the flowing fluid and the turbine rotor blades and depends on turbine design for simplicity and efficiency. Many different designs may be employed to achieve the required power to rotate the sprinkler head, as will be appreciated by those skilled in the art.

To allow simpler construction, inner housing 50 may be eliminated. However, inner housing 50 provides protection from high bypass flow velocities and dirt for turbine rotor 46. Discharge ports 65 also provide an additional throttling mechanism to limit the turbine speed when it is being blown out.

Figure 6:
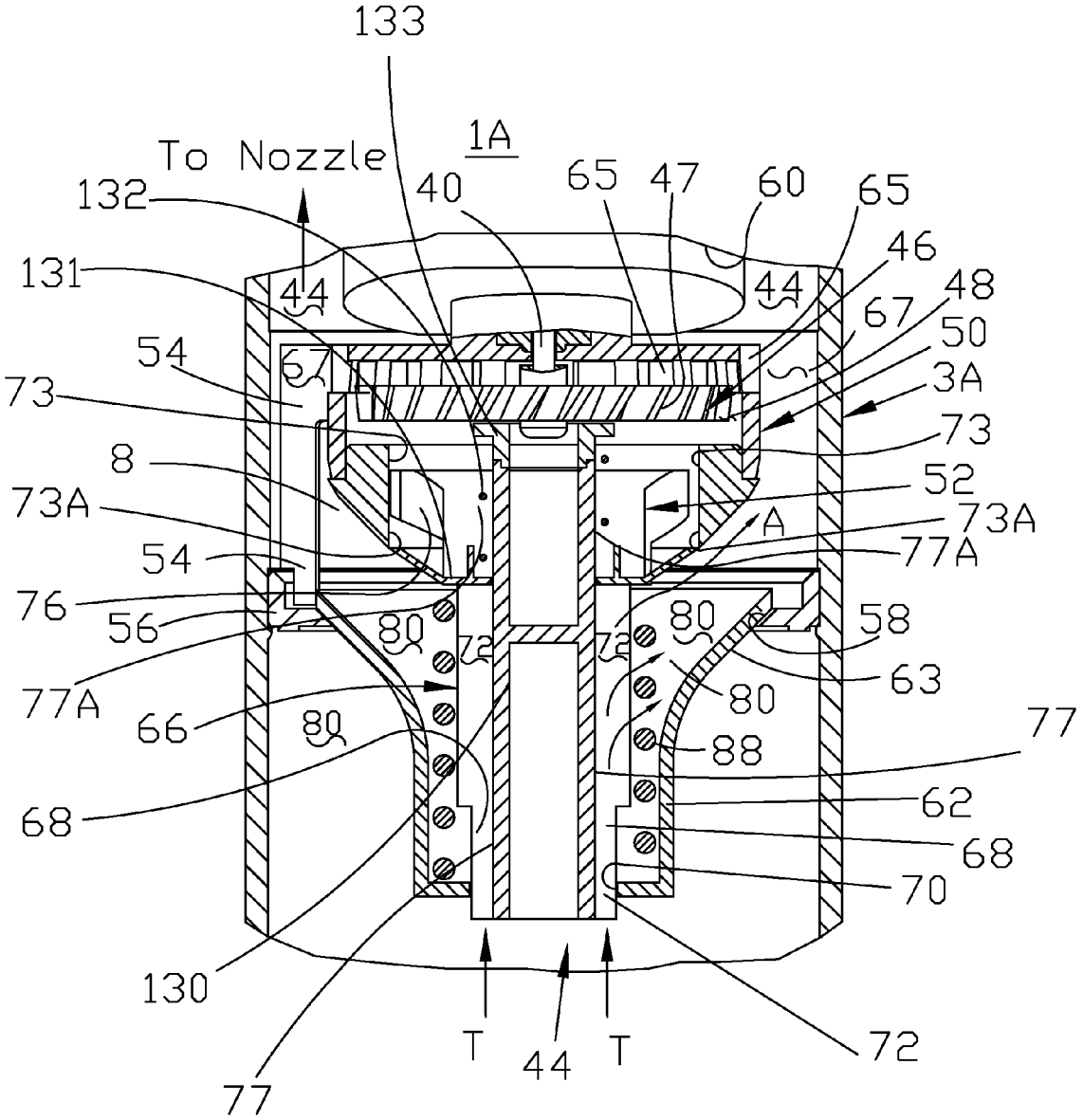
FIG. 6 is a cross-sectional elevation view of the drive turbine area of a turbine driven sprinkler according to a third embodiment of the present disclosure.

FIG. 6 shows a cross sectional elevation view of the drive turbine area 1B of a turbine driven sprinkler according to a third embodiment of the present disclosure. In this embodiment, a second spring loaded bypass valve member 131 has been added which is preloaded by compression spring 133 that holds turbine bypass valve member 131 in its bypass position as shown in FIG. 6. The turbine flow velocity, as established through orifice areas 72 is directed upward against the bottom surface of the second spring loaded bypass valve member 131. If the flow through the orifice 72 is primarily air, the momentum imparted by this flow is insufficient to move the valve member 131.

Specifically, the momentum of air imparted against the spring loaded bypass valve member 131 is 1/20 that of water at the same pressure. Thus, where air is the primary medium flowing through the orifice 72, the valve member 131 will not be displaced upwardly against the biasing spring 133. In the bypass position illustrated in FIG. 6, any fluid flowing from orifice area 72 is diverted around the turbine.

Where the fluid passing through the orifice 72 is a combination of air and water, the momentum imparted on the spring loaded bypass valve member 131 will partially displace the valve member upward. This will result in the valve member 131 restricting the flow that strikes the turbine, and thus, limits speed.

In short, the second spring loaded bypass valve member 131 is actuated by the much higher momentum of water. When air is present in the flow from orifice 72, the much lower momentum (more that 20 times less than water), allows this second valve 131 to remain closed or partially closed to the turbine area. Thus, the fluid, or a portion thereof, bypasses the turbine to prevent it from over-speeding as it would otherwise due based on the high velocity air that drives it.

Figure 7:
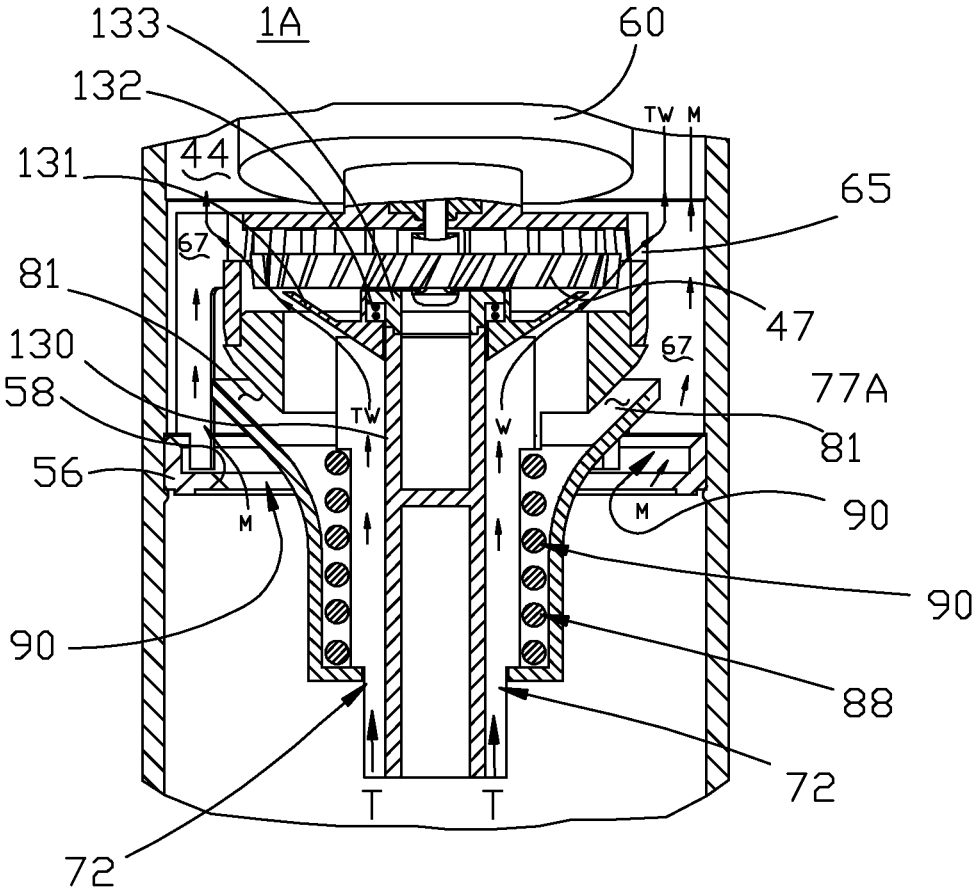
FIG. 7 is the same cross-sectional view of FIG. 6 with the momentum actuated bypass valve member shown with the valve member having been moved (depressed).

FIG. 7 illustrates the turbine area 2B of FIG. 6 where the flow through orifice 72 is primarily water. The water is directed axially upward against the bottom surface of the second spring loaded bypass valve member 131. The momentum of the water depresses the bias spring 133 and moves the valve member 131 axially up to "open" the flow onto the turbine drive. The water flow is directed by the bottom surface of member 131 onto the blades 47 of the drive turbine.

Figure 8:
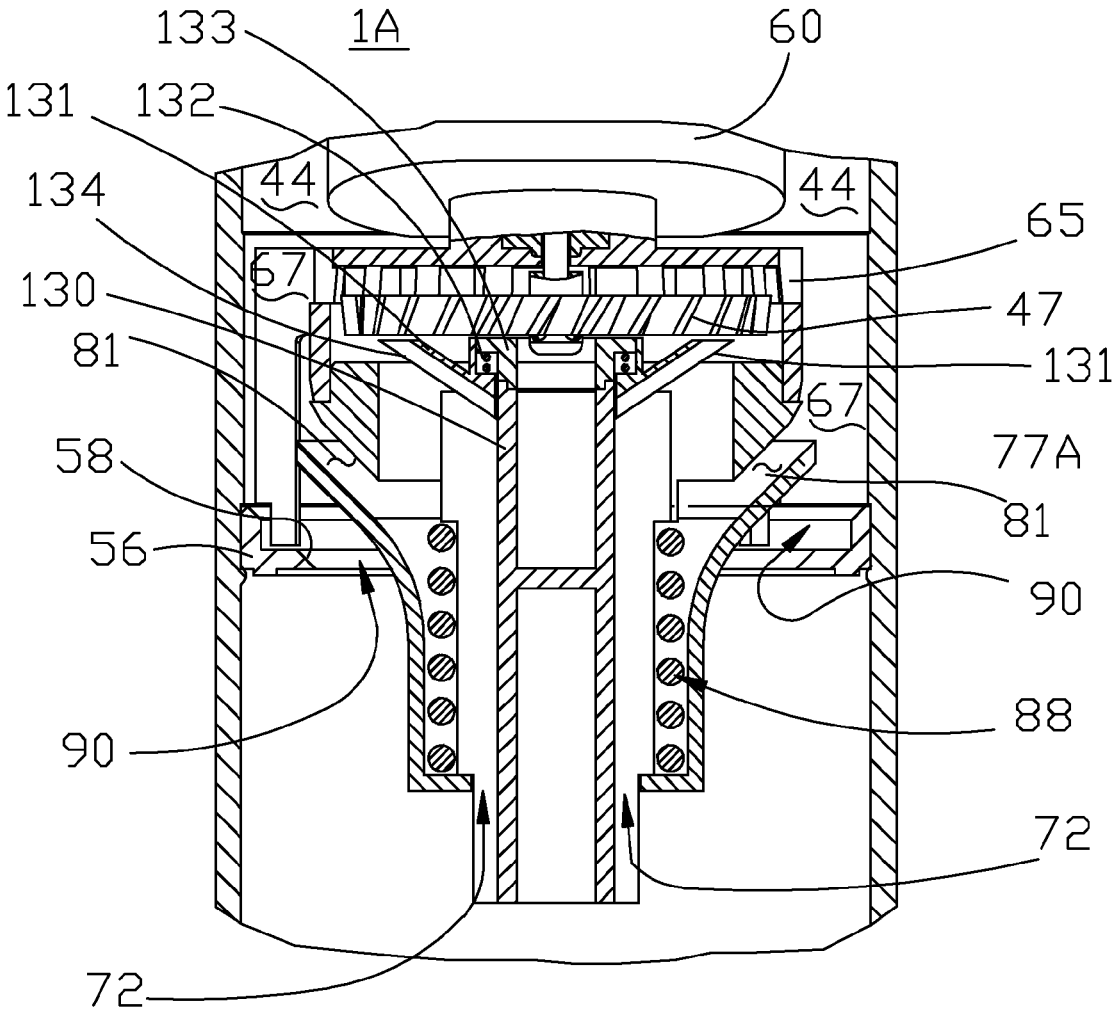
FIG. 8 shows the swirl ribs that may be positioned on the bypass valve of FIGS. 6 and 7.

In one embodiment, illustrated in FIG. 8, for example, the bottom surface of the valve member 131 may include swirl ribs 134 slanting on it to swirl the flow in a manner similar to the swirl ribs 76 shown in FIG. 2 and FIG. 4.

The upstream flow bypass valve 62 simply provides the basic turbine pressure differential $\Delta P$ regardless of whether the fluid is air or water. The second valve member 131 is used to selectively divert the pressurized air or air and water, as desired, to prevent over-speeding.

Although the present invention has been described in relation to particular embodiments thereof, many other variations and modifications and other uses will become apparent to those skilled in the art.

What is claimed is:

1. A sprinkler, comprising:

a riser for receiving a pressurized fluid;

a nozzle;

a mounting device configured to mount the nozzle at an upper end of the riser for rotation about an axis;

a turbine mounted for rotation inside the riser and in fluid communication with the pressurized fluid;

a drive device connected between the turbine and the nozzle such that rotation of the turbine by the pressurized fluid will rotate the nozzle;

a first valve positioned upstream from the turbine and configured to selectively re-direct at least a portion of the pressurized fluid around the turbine when the pressurized fluid is air or a mixture of water and air the first valve including:

a valve seat positioned adjacent to the inlet of the turbine chamber;

a central opening formed in the valve seat in fluid communication with an area upstream of the turbine chamber;

a valve member movably mounted in the first valve and configured to move from a closed position in which it directs the pressurized fluid to bypass the turbine chamber and an open position in which it directs the pressurized fluid into the turbine chamber; and a second valve positioned upstream from the first valve and configured to maintain a desired pressure differential across the turbine.

2. The sprinkler of claim 1, wherein the turbine further comprises:

a stator positioned downstream of an inlet of a turbine chamber in which the turbine is mounted;

a rotor position downstream of the stator and rotatably mounted in the turbine chamber, wherein the pressurized fluid is directed by the stator to the rotor to rotate the rotor to turn the drive device.

3. The sprinkler of claim 1, wherein the first valve further comprises a biasing element configured to bias the valve member in the closed position until sufficient force is applied to a bottom surface of the valve member by the pressurized fluid to overcome a bias force of the biasing element and to move the valve member into the open position to allow the pressurized fluid to flow into the turbine chamber.

4. A sprinkler comprising:

a turbine in fluid communication with a pressurized fluid, the turbine driven to rotate by the pressurized fluid; and a valve positioned upstream from the turbine and configured to selectively re-direct at least a portion of the pressurized fluid around the turbine when the pressurized fluid is air or a mixture of water and air:

the valve including:

a first valve element biased into a first position to direct at least a portion of a flow of the pressurized fluid toward the turbine to provide a desired pressure, and a second valve element positioned downstream from the first valve element and biased in a bypass position by a biasing element to direct the flow of pressurized fluid from the first valve element around the turbine, a biasing force of the biasing element set such that the second valve element moves into a second position to direct the flow of pressurized fluid toward the turbine when the pressurized fluid does not include air such that a force applied by the pressurized fluid on the second valve element is larger than the biasing force.

* * * * *